US012429228B2

(12) United States Patent
Kahane et al.

(10) Patent No.: US 12,429,228 B2
(45) Date of Patent: Sep. 30, 2025

(54) CONSOLE ASSEMBLY AND METHOD FOR ASSEMBLING A CONSOLE ASSEMBLY OF A COOKING APPLIANCE

(71) Applicant: WHIRLPOOL CORPORATION, Benton Harbor, MI (US)

(72) Inventors: Nikhil B. Kahane, Maharashtra (IN); Parag V. Mantrawadi, Maharashtra (IN); Devendra B. Shirore, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 670 days.

(21) Appl. No.: 17/695,465

(22) Filed: Mar. 15, 2022

(65) Prior Publication Data

US 2023/0296261 A1 Sep. 21, 2023

(51) Int. Cl.

| | |
|---|---|
| ***F24C 7/08*** | (2006.01) |
| ***F24C 3/12*** | (2006.01) |
| ***F24C 5/16*** | (2006.01) |

(52) U.S. Cl.

CPC ..... *F24C 7/082* (2013.01); *F24C 3/12* (2013.01); *F24C 3/124* (2013.01); *F24C 3/126* (2013.01); *F24C 5/16* (2013.01); *F24C 7/08* (2013.01)

(58) Field of Classification Search

CPC ..... F24C 7/086; F24C 3/124; F24C 3/122; F24C 3/126; F24C 5/16; F24C 7/08; F24C 7/082; F24C 3/12; F24C 7/081

See application file for complete search history.

(56) References Cited

U.S. PATENT DOCUMENTS

| | | | | |
|---|---|---|---|---|
| 4,074,825 | A | 2/1978 | Smith | |
| 4,894,493 | A | 1/1990 | Smith et al. | |
| 9,476,594 | B2 * | 10/2016 | Fockler | F24C 3/124 |
| 9,513,013 | B2 | 12/2016 | May et al. | |
| 9,732,963 | B2 | 8/2017 | Kozinski et al. | |
| 10,801,732 | B2 | 10/2020 | Kozinski et al. | |
| 10,976,842 | B2 | 4/2021 | Winkelmann et al. | |
| 11,019,746 | B1 * | 5/2021 | Balekundri | F24C 3/12 |
| 2016/0201877 | A1 | 7/2016 | Ebrom et al. | |
| 2018/0274790 | A1 * | 9/2018 | Kim | F24C 3/124 |
| 2019/0121223 | A1 | 4/2019 | Tokunaga et al. | |

(Continued)

FOREIGN PATENT DOCUMENTS

| | | | |
|---|---|---|---|
| CN | 109915862 | B | 6/2021 |
| CN | 113545175 | A | 10/2021 |

(Continued)

*Primary Examiner* — Steven B McAllister
*Assistant Examiner* — Amy E Carter
(74) *Attorney, Agent, or Firm* — Price Heneveld LLP

(57) ABSTRACT

According to one aspect of the present disclosure, a cooking appliance includes a cabinet that defines a cooking cavity. A door is coupled with the cabinet. The cooking appliance includes a console assembly that includes a console frame coupled with the cabinet. The console frame defines at least one opening. The console assembly includes an interface assembly for controlling an operation of the cooking appliance. A bonding member extends between the console frame and the interface assembly to form a permanent bond between the interface assembly and the console frame. At least one locator engages the at least one opening to align the interface assembly with the console frame during formation of the permanent bond.

11 Claims, 11 Drawing Sheets

(56) References Cited

U.S. PATENT DOCUMENTS

| | | | | |
|---|---|---|---|---|
| 2020/0271326 | A1* | 8/2020 | Kozinski | F24C 3/124 |
| 2021/0010676 | A1 | 1/2021 | Davison et al. | |
| 2023/0136332 | A1* | 5/2023 | Pierce | F24C 3/126<br>126/39 R |

FOREIGN PATENT DOCUMENTS

| | | | |
|---|---|---|---|
| DE | 102014224116 | A1 | 12/2015 |
| EP | 2650613 | A1 | 10/2013 |

* cited by examiner

CONSOLE ASSEMBLY AND METHOD FOR ASSEMBLING A CONSOLE ASSEMBLY OF A COOKING APPLIANCE

BACKGROUND OF THE DISCLOSURE

The present disclosure generally relates to a console assembly, and more specifically, to a method of assembling a console assembly of a cooking appliance.

SUMMARY OF THE DISCLOSURE

According to one aspect of the present disclosure, a cooking appliance includes a cabinet that defines a cooking cavity. A door is coupled with the cabinet. The cooking appliance includes a console assembly that includes a console frame coupled with the cabinet. The console frame defines at least one opening. The console assembly includes an interface assembly for controlling an operation of the cooking appliance. A bonding member extends between the console frame and the interface assembly to form a permanent bond between the interface assembly and the console frame. At least one locator engages the at least one opening to align the interface assembly with the console frame during formation of the permanent bond.

According to another aspect, a console assembly for a cooking appliance includes an interface assembly for controlling an operation of the cooking appliance. A console frame operably couples the interface assembly with the cooking appliance. The console frame defines at least one opening. A bonding member is disposed between the console frame and the interface assembly. At least one pin extends from the interface assembly and is configured to engage the at least one opening to align the interface assembly with the console frame.

According to yet another aspect, a method for assembling a console assembly of a cooking appliance includes coupling a locator to an interface assembly of the console assembly. The method further includes forming an opening operable to receive the locator in a console frame of the console assembly. The method further includes positioning the locator adjacent the opening, engaging the interface assembly with the console frame, receiving force data corresponding to a force applied by the interface assembly to the console frame, and adjusting a position of the interface assembly based on the force data to align the locator with the opening.

These and other features, advantages, and objects of the present disclosure will be further understood and appreciated by those skilled in the art by reference to the following specification, claims, and appended drawings.

Figure 1:
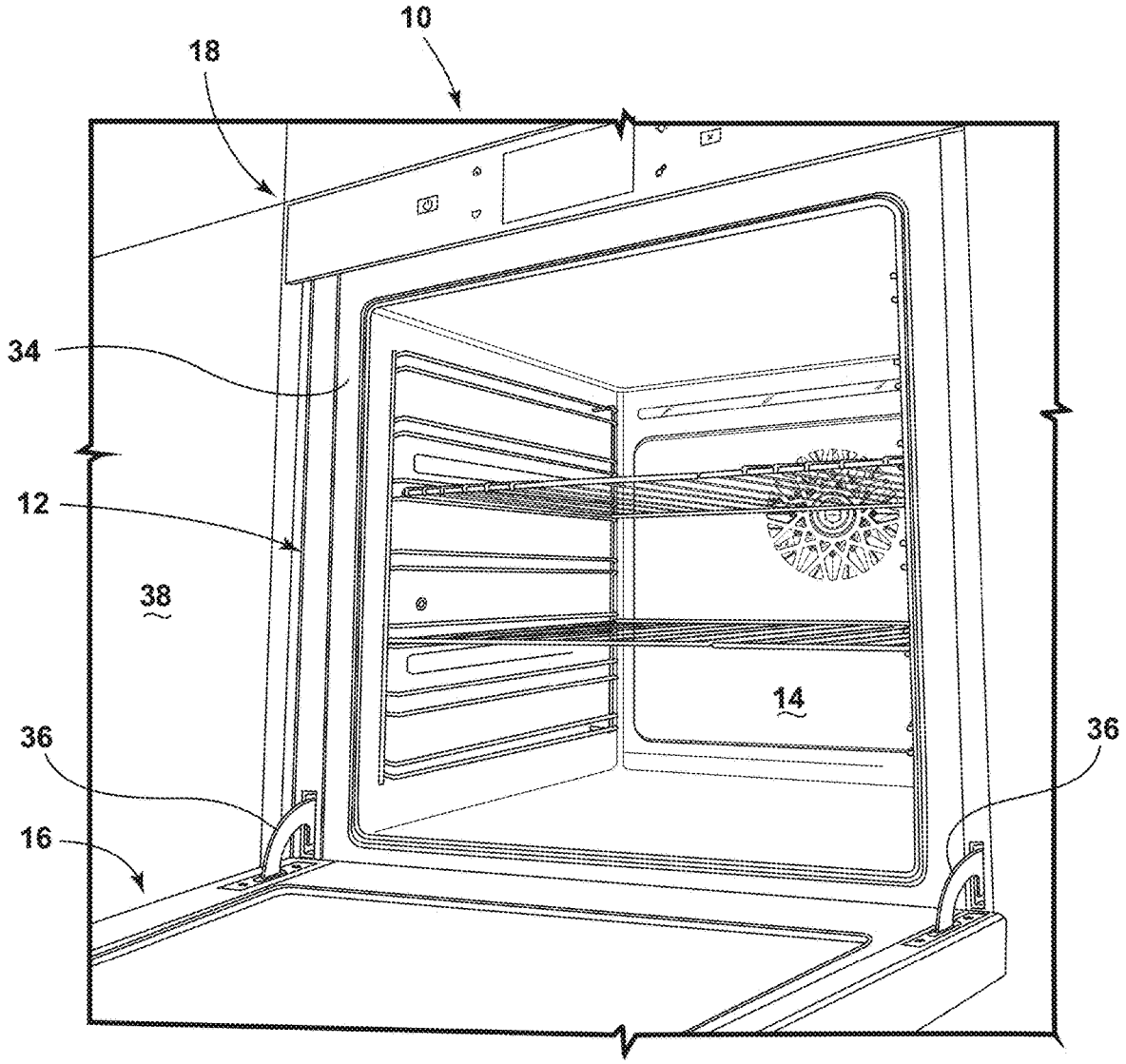
FIG. 1 is a front perspective view of a cooking appliance according to one aspect of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a console assembly of a cooking appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

Figure 2:
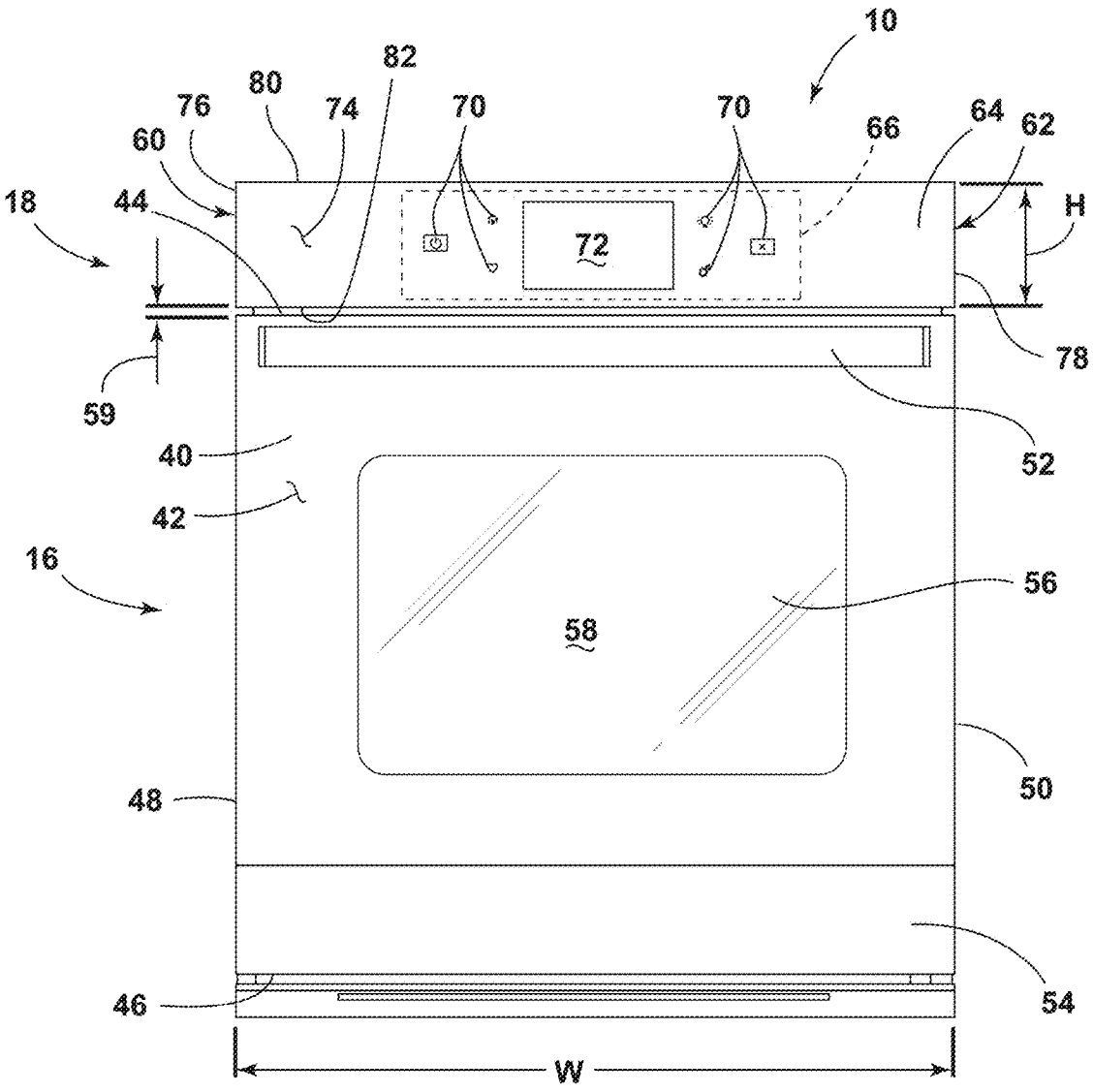
FIG. 2 is a front elevational view of a cooking appliance according to one aspect of the present disclosure.

For purposes of description herein, the terms "upper," "lower," "right," "left," "rear," "front," "vertical," "horizontal," and derivatives thereof shall relate to the disclosure as oriented in FIG. 2. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-7, reference numeral 10 generally designates a cooking appliance. The cooking appliance 10 includes a cabinet 12 that defines a cooking cavity 14. A door 16 is coupled with the cabinet 12 for selectively covering the cooking cavity 14. A console assembly 18 is coupled with the cabinet 12. The console assembly 18 includes a console frame 20 coupled with the cabinet 12. The console frame 20 defines at least one opening 22, 24. The console assembly 18 further includes an interface assembly 26 for controlling an operation of the cooking appliance 10. A bonding member 28 extends between the console frame 20 and the interface assembly 26 to form a permanent bond between interface assembly 26 and the console frame 20. At least one locator 30, 32 engages the at least one opening 22, 24 to align the interface assembly 26 with the console frame 20 during formation of the permanent bond.

Referring more particularly to FIG. 1, the cooking appliance 10 is illustrated as a wall-mounted oven. It is contemplated that the cooking appliance 10 described herein may be any one of a variety of cooking appliances including, for example, a microwave oven, a range, a toaster oven, or the like. Similarly, although illustrated as coupled with a wall-mounted oven, it is generally contemplated that the console assembly 18 described herein may be used with any one of a variety of cooking appliances. The cooking appliance 10 includes an appliance frame 34 to which the door 16 is coupled. The door 16 is pivotable about a hinge 36 between an open position and a closed position. In the open position, the cooking cavity 14 is accessible from an exterior 38 of the cooking appliance 10. In the closed position, the door 16 covers the cooking appliance 10 to allow the cooking cavity 14 to heat in response to initiation of a cooking cycle.

Referring more particularly to FIG. 2, the door 16 for the cooking appliance 10 includes a door panel 40 facing the exterior 38 and having a generally rectangular shape. The door panel 40 can be made of glass or another transparent substrate. The door panel 40 includes a frontward surface 42 extending between an upper edge 44 adjacent the interface assembly 26 and a lower edge 46 opposite the upper edge 44. The upper and lower edges 44, 46 are interconnected by a pair of lateral edges 48, 50 spaced apart from one another by a width W of the cooking appliance 10. A handle 52 is disposed adjacent the upper edge 44 to allow a user to move the door 16 between the open position and the closed position. A skin 54 is disposed on the frontward surface 42 of the door panel 40 adjacent the lower edge 46. The skin 54 may be comprised of metal and/or have a metalized coating, and may also provide additional insulation between the cooking cavity 14 and the exterior 38. The door 16 may further include a viewing window 56 disposed in a central portion 58 of the door panel 40 to allow a user to view the cooking cavity 14 from the exterior 38. As illustrated, the console assembly 18 extends generally parallel with the upper edge 44 along the width W of the cooking appliance 10. The door 16 and the console assembly 18 define a gap 59 therebetween, the specific dimensions of which are discussed further herein.

The interface assembly 26 of the console assembly 18 extends along the width W of the cooking appliance 10 between a first end 60 (e.g., left end) of the console assembly 18 and a second end 62 (e.g., right end) of the console assembly 18, opposite the first end 60. The interface assembly 26 includes a console panel 64 and an interface module 66. The interface module 66 connects to a rear surface 68 of the panel 64 (see FIG. 7) and may include various user input devices, such as buttons 70, for operating the cooking appliance 10. The interface module 66 also includes a display 72, which may be an interactive display capable of receiving touch sensitive inputs from the user to control the cooking appliance 10. In some configurations, the display 72 is operable to indicate the status of the cooking appliance 10, time information, as well as control a heating element of the cooking appliance 10. The panel 64 may be made of glass or another insulative material. The panel 64 has a generally rectangular shape and includes a front surface 74, opposite the rear surface 68, extending between side edges 76, 78 that are spaced apart approximately by the width W of the cooking appliance 10. A top edge 80 and a bottom edge 82 of the front surface 74 extend between the side edges 76, 78, with the bottom edge 82 delimiting the gap 59 between the door 16 and the console assembly 18. According to some aspects of the present disclosure, a first distance across the gap 59 is approximately 5 mm. According to some aspects of the present disclosure, the first distance is in the range of 2 mm and 8 mm. The first distance is measured along any line between the upper edge 44 of the door 16 and the bottom edge 82 of the console assembly 18 in a direction corresponding to a height H of the console assembly 18 (e.g., substantially parallel to the lateral edges 48, 50 and/or the side edges 76, 78).

According to some aspects of the present disclosure, various features described herein as features of the console assembly 18 may also be referred to as features of an individual component of the console assembly 18, and vice versa. For example, the ends 60, 62 of the console assembly 18 may also be referred to as ends 60, 62 of the panel 64 and/or the interface assembly 26. Similarly, at least some of the rear surface 68 of the panel 64 may be referred to as the rear surface 68 of the interface assembly 26, for example, portions of the rear surface 68 not adhered with the interface module 66.

According to some aspects of the present disclosure, a left side edge 76 of the side edges 76, 78 is aligned with a left lateral edge 48 of the lateral edges 48, 50. Similarly, a right side edge 78 of the side edges 76, 78 is aligned with a right lateral edge 50 of the lateral edges 48, 50. For example, the left lateral edge 48 may be substantially collinear with the left side edge 76. Similarly, the right lateral edge 50 may be substantially collinear with the right side edge 76. According to some configurations, the left and right side edges 76, 78 extend along first and second lines, respectively, and the left and right lateral edges 48, 50 extend along third and fourth lines, respectively. In some configurations, the first line and the second line are parallel to and spaced from one another in a left or right direction (e.g., laterally) by a second distance. Similarly, the second and fourth lines may be parallel to and spaced from one another in the left or right directions by the second distance. The second distance may be in the range of greater than 0 mm to 2 mm. In these configurations, the lateral edges 48, 50 and the side edges 76, 78 are substantially aligned with one another.

Figure 3:
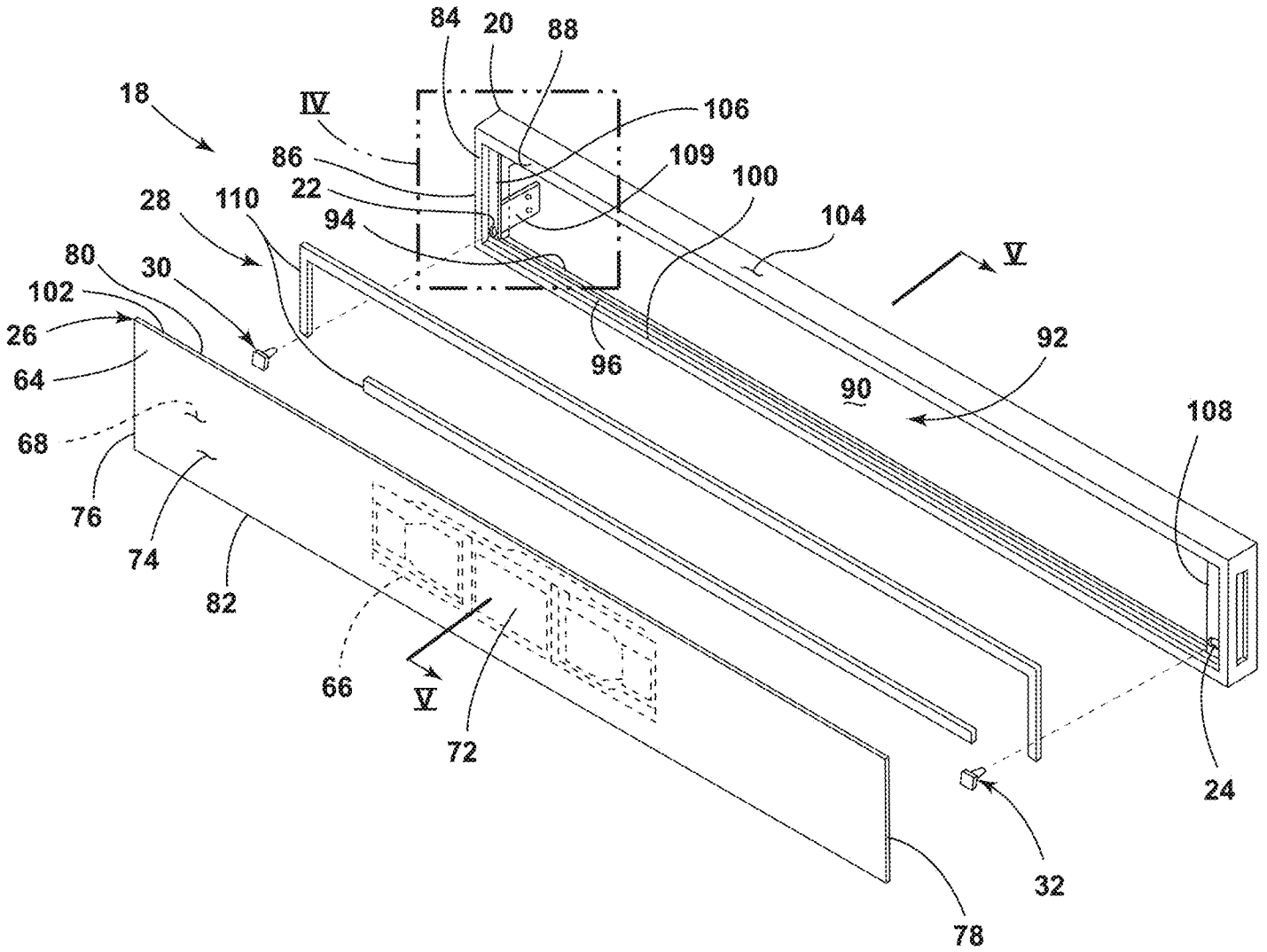
FIG. 3 is an exploded front perspective view of a console assembly for a cooking appliance according to one aspect of the present disclosure.
Figure 4:
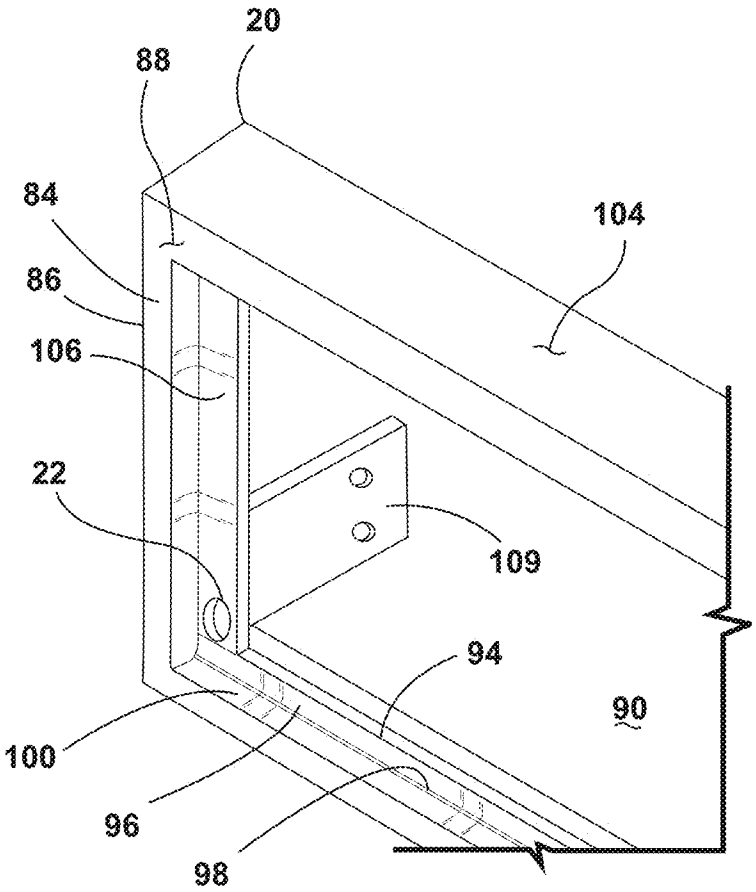
FIG. 4 is a fragmentary perspective view of a console frame of the console assembly taken at the region IV of FIG. 3.
Figure 5:
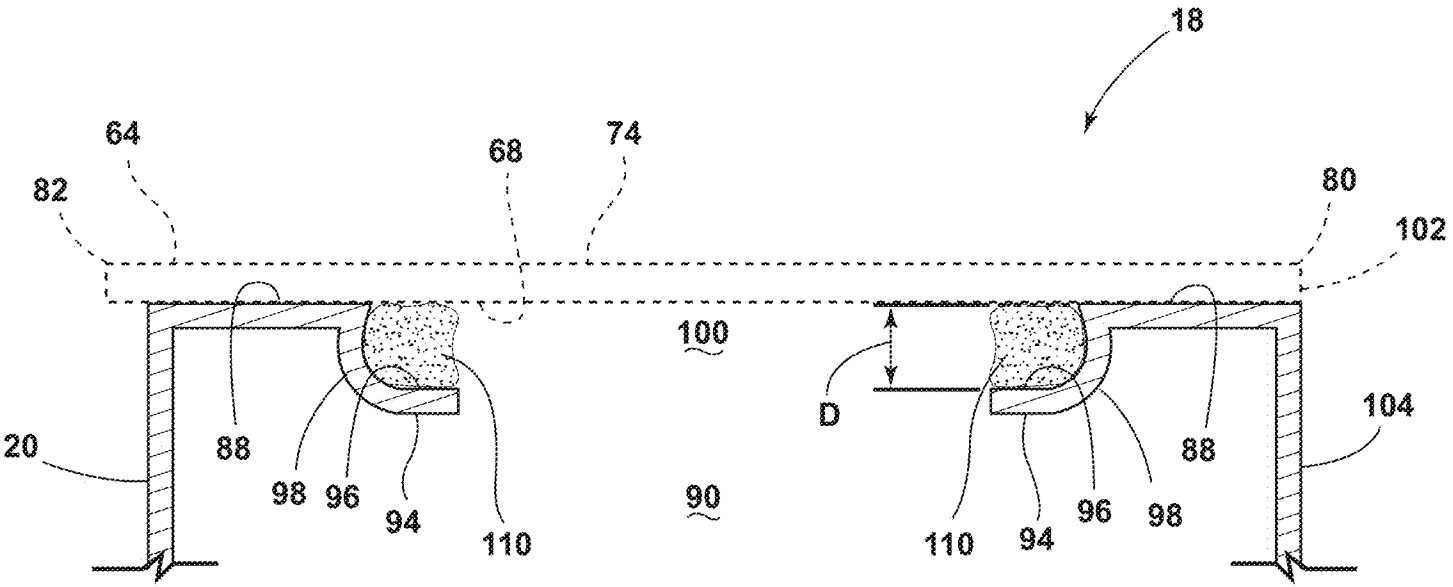
FIG. 5 is a cross-sectional view of the console frame taken at the line V of FIG. 3 with an interface module omitted for clarity.

Referring now to FIGS. 3-5, the at least one locator 30, 32 includes a first locator 30 and a second locator 32. Although described herein as incorporating two locators 30, 32, it is contemplated that any number of locators 30, 32 may be incorporated with the console assembly 18. The first locator 30 is disposed adjacent the first end 60 of the console assembly 18 and the second locator 32 is disposed adjacent the second end 62 of the console assembly 18. The first and second locators 30, 32 may alternatively be referred to as first and second pins 30, 32, respectively, according to some configurations. It is generally contemplated that the first and second locators 30, 32 may form any one of a variety of shapes. For example, the locators 30, 32 may be square-shaped pins, or pegs, or may be protrusions operable to engage grooves or detents formed on the console assembly 18. In general, the first and second locators 30, 32 may be referred to as one part of a connection arrangement, such as a male part, and features of the console assembly 18 (e.g., openings 22, 24) may be a female part of the connection arrangement. Alternatively, the male part is formed on the console frame 20 and the female part is formed on the panel 64.

Referring more particularly to the console frame 20, the console frame 20 includes a peripheral member 84 extending about a periphery 86 of the console frame 20. The peripheral member 84 includes an outer surface 88 that faces the rear surface 68 of the panel 64. As illustrated in FIG. 3, the console frame 20 defines a hollow 90 disposed in a central part 92 of the console frame 20 and extending through a thickness of the console frame 20. According to some configurations, the hollow 90 is omitted and the console frame 20 may form a plate or other connecting structure extending between the ends 60, 62. In configurations incorporating the hollow 90, the interface assembly 26 may be accessible when the console assembly 18 is detached from the cooking appliance 10 (e.g., via access from a backside of the console assembly 18).

The console frame 20 further includes a support member 94 that extends radially inwardly from the peripheral member 84 and includes an inner surface 96 upon which the bonding member 28 is disposed as depicted in FIG. 4. The support member 94 may be arcuate in shape and form a flange 98 that extends annularly from the peripheral member 84. The inner surface 96 may extend generally parallel to the outer surface 88 and is alternatively referred to herein as a recessed surface. The console frame 20 defines an outer recess 100 having a depth D between the outer surface 88 and the inner surface 96. In some configurations, the depth D of the outer recess 100 is defined as the distance between the inner surface 96 and a plane in which the outer surface 88 resides, measured in a direction generally orthogonal to the plane. This direction may also correspond to a horizontal direction when the console assembly 18 is attached with a wall-mounted oven. The plane may also be adjacent to the new surface of the console panel 64 when the console assembly 18 is assembled.

In addition to the console assembly 18 being generally aligned with the door 16 of the cooking appliance 10, components of the console assembly 18 may further be aligned with one another. For example, the panel 64 is substantially aligned with the console frame 20 along the top edge 80 and the side edges 76, 78. More specifically, a top surface 102 of the panel 64 corresponding to the top edge 80 of the panel 64 is substantially coplanar with an upper surface 104 of the console frame 20. In this way, the panel 64 may be flush with the console frame 20 along a top of the console assembly 18. The console panel 64 may further be substantially flush with the console frame 20 along the side edges 76, 78. In some configurations, a left side surface of the console frame 20 and a left side surface of the panel 64 are laterally spaced from one another in the right or left directions in the range of 0 mm (e.g., coplanar) and 2 mm. Similarly, a right side surface of the console frame 20 may be laterally spaced from a right side surface of the panel 64 in the right or left directions in the range of 0 mm (e.g., coplanar) and 2 mm.

According to some aspects, the side surface of the console frame 20 may be spaced laterally outwardly from the corresponding side surface of the console panel 64 by approximately 1 mm. In this way, the console frame 20 and the panel 64 may be centrally aligned (e.g., having similar or equal overlap along sides of the console assembly 18) along the width W of the cooking appliance 10. For example, a first midplane dividing the panel 64 in half along its length may be vertically aligned with a second midplane dividing the console frame 20 in half along its length, with the console frame 20 extending approximately 1 mm beyond the lateral edges 48, 50 on each side of the console assembly 18. According to some aspects, the panel 64 overhangs the frame 20 along the bottom edge 82 by approximately 0.725 mm (see FIG. 5).

With continued reference to FIGS. 3-5, the support member 94 may include a first end bracket 106 and a second end bracket 108. The first end bracket 106 is disposed adjacent the first end 60 and the second end bracket 108 is disposed adjacent the second end 62. The inner surface 96 of the support member 94 is generally continuous between the end brackets 106, 108, although it is generally contemplated that the inner surface 96 may be discontinuous along the outer recess 100. For example, the inner surface 96 may be omitted along portions of the console frame 20 not necessary for supporting the bonding member 28. It is generally contemplated that the inner surface 96 is generally planar. The at least one opening 22, 24 includes a first opening 22 and a second opening 24, each formed on the inner surface 96 of the support member 94, with the first opening 22 formed on the first end bracket 106 and the second opening 24 formed on the second end bracket 108. As further discussed herein, the size and/or shape of the first opening 22 may be similar to or different than the size and/or shape of the second opening 24. The shape of the openings 22, 24 may or may not correspond to the shape of the corresponding locator 30, 32. For example, the shape of the first opening 22 may be oval-shaped, oblong, rectangular, triangular, etc., while the first locator 30 may be cylindrically shaped, square-shaped, etc. These features are discussed in further detail with respect to FIGS. 6 and 7.

The console frame 20 also includes one or more securing mechanisms 109 for engaging the cabinet 12 of the cooking appliance 10. A pair of the one or more securing mechanisms 109 extend from the first and second ends 60, 62 and may provide an outward lateral force to pinch or otherwise couple the console assembly 18 with the cooking appliance 10. Other fastening mechanisms may extend from the console assembly 18 for attachment with the appliance frame 34.

According to some aspects of the disclosure, the bonding member 28 is a room temperature vulcanizing glue (RTV glue) comprising silicone. The bonding member 28 may include one or more beads 110 of glue positioned adjacent inner surface 96 in the outer recess 100. By disposing the bonding member 28 interior relative to the outer surface 88 and/or the periphery 86 of the console frame 20, glue may be prevented from seeping out of the console assembly 18. The bonding member 28 spans the depth D of the outer recess 100, as illustrated in FIG. 5. The bonding member 28 forms a permanent bond between the panel 64 and the console frame 20 following curing of the bonding member 28. In some configurations, the curing time for the permanent bond is in the range of one hour to several days. According to some aspects, the curing time of the permanent bond is at least 7 days. During the curing time of the permanent bond, the console assembly 18 may undergo further operations of an assembly process that involves interaction with external stabilizing features (e.g., clamps, locators, fixtures, etc.). The alignment feature of the present disclosure can maintain stability and/or alignment of the panel 64 with the console frame 20, as well as the permanent bond, during vibration caused by movement of the stabilizing features (e.g., clamps engaging the console assembly 18).

Referring more particularly to FIG. 5, the bonding member 28 is disposed in the outer recess 100 and extends between the inner surface 96 of the console frame 20 and the rear surface 68 when the console assembly 18 is assembled. As illustrated, the console panel 64 overhangs the console frame 20 along the bottom edge 82 of the console panel 64 and is generally flush with the console frame 20 along the top edge 80. The relative position of the console panel 64 and the console frame 20, such as the overhang of the bottom edge 82, may be maintained via the alignment feature of the present disclosure. The alignment feature (e.g., the locators 30, 32 and openings 22, 24) of the present disclosure may provide for a more efficient manufacturing process of the console assembly 18 by allowing the console assembly 18 to be moved and/or handled in other processes while the bonding member 28 cures. In addition, the alignment feature may provide for a reliable way of limiting misalignment of the console assembly 18 while the permanent bond is formed.

Figure 6:
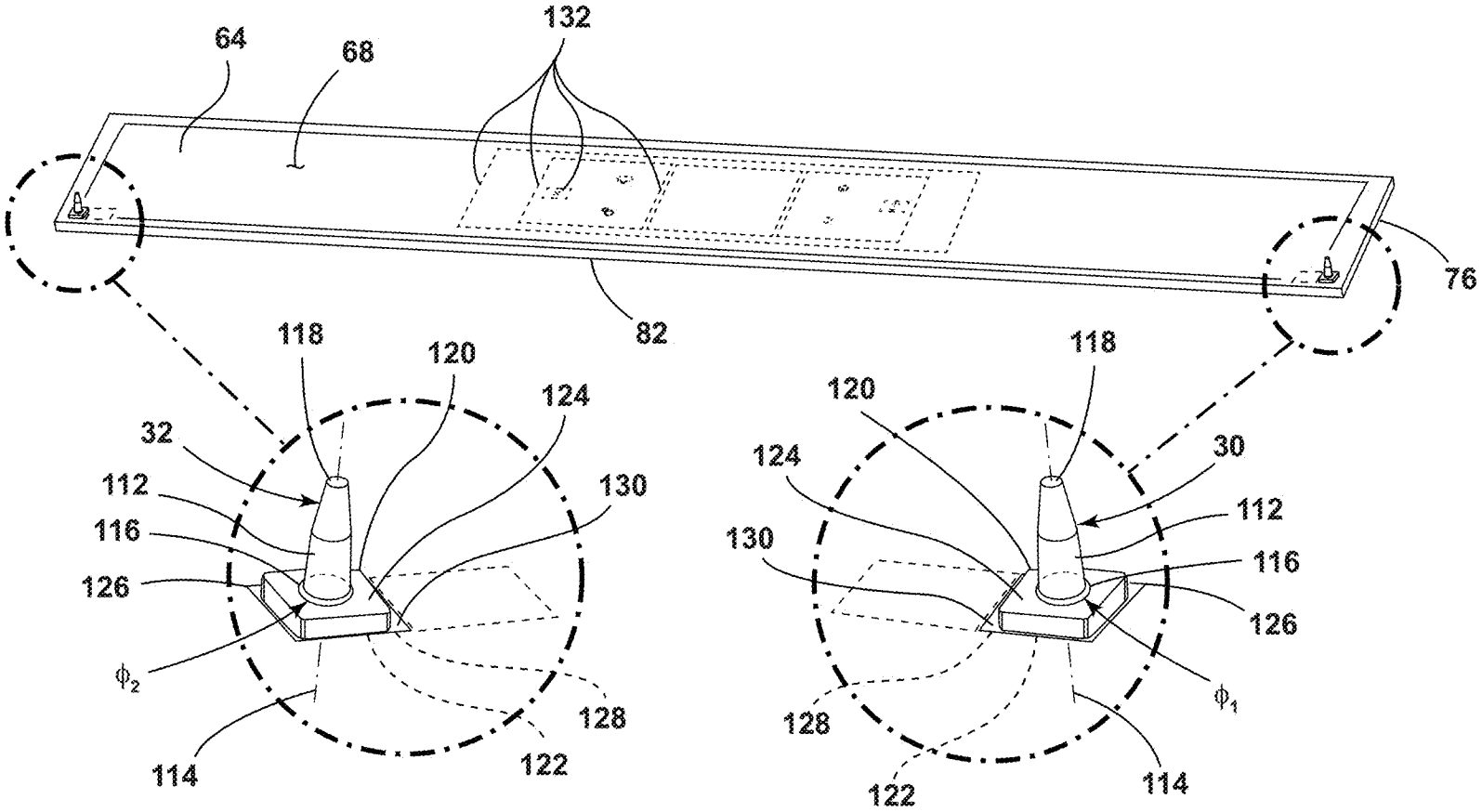
FIG. 6 is a rear perspective view of a panel of a console assembly of the present disclosure with enlarged views of two locators coupled to the panel.
Figure 7:
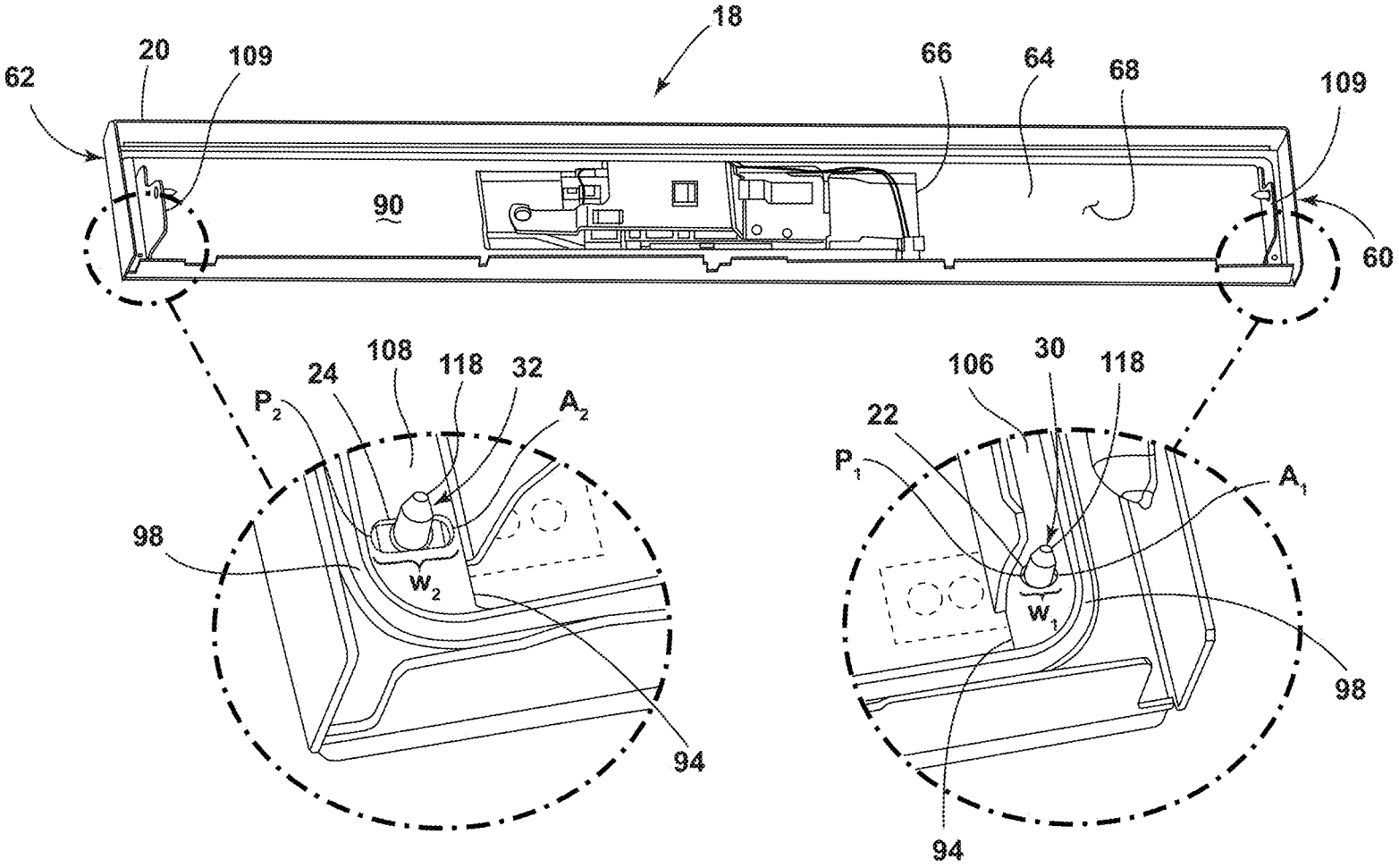
FIG. 7 is a rear perspective view of a console assembly according to one aspect of the present disclosure with enlarged views of the locators engaging openings of a console frame.

Referring now to FIGS. 6 and 7, details of the first and second locators 30, 32 are shown. As previously described, the first and second locators 30, 32 may be first and second pins extending from the rear surface 68 of the panel 64. Each pin 30, 32 includes a body 112 that extends along a central axis 114 between a proximal end 116 and a distal end 118. When the pins 30, 32 engage the openings 22, 24, the distal end 118 is received in the corresponding opening 22, 24, as well as at least a portion of the body 112. Each pin 30, 32 also includes a base 120 coupled to the body 112 for supporting the body 112 in an upright configuration, as illustrated. The base 120 is generally rectangular in shape, though any shape may be provided to provide stability to the body 112. The base 120 includes an attachment surface 122 that faces the interface assembly 26 and an intermediate surface 124 that connects the base 120 with the body 112 at the proximal end 116. An attachment member 126 is disposed between the interface assembly 26 and the first and second pins 30, 32 to couple the pins 30, 32 with the interface assembly 26. The attachment member 126 includes a first surface 128 and a second surface 130 that is opposite the first surface 128. The first surface 128 adhesively couples with the rear surface 68 of the interface assembly 26, and the second surface 130 adhesively couples with the attachment surface 122 of each pin 30, 32. According to some aspects, the attachment member 126 is a two-sided tape that may extend beyond the attachment surface 122 in an elongated manner along the rear surface 68, as illustrated.

The body 112 may have a conical or frustoconical shape between the proximal end 116 and the distal end 118, though any shape capable of engaging the openings 22, 24 to provide alignment of the interface assembly 26 with the console frame 20 can be used. In some configurations, the body 112 has a frustoconical shape adjacent the distal end 118 and a cylindrical shape at the proximal end 116. In some configurations, the first pin 30 and the second pin 32 may be substantially similar or identical in structure, and in other configurations the pins 30, 32 have differing structures. In one example, the first pin 30 has a first diameter $Ø_1$ and the second pin 32 has a second diameter $Ø_2$. In this example, the first diameter $Ø_1$ and the second diameter $Ø_2$ are substantially equal. The first and second diameters $Ø_1$, $Ø_2$ may be taken along a plane perpendicular to the central axis 114 at any point along the body 112 of the pin 30, 32, but in some configurations, the first and second diameters $Ø_1$, $Ø_2$ are taken adjacent the proximal end 116. Each pin 30, 32 may be comprised of metal or plastic, and/or may be in the shape of a clinch pin that is tapered toward the distal end 118. For example, each locator 30, 32 may be a metal clinch pin secured with a layer of sheet metal that forms the base 120. In this configuration, the layer of sheet metal defines a grooved hole in which the pin body 112 is disposed and fastens to. The clinch pin may have a tapered head such that the attachment surface 122 of the layer of sheet metal is generally flat. In some configurations, the pins 30, 32 are substantially transparent to not interfere with a visible appearance of the console assembly 18 when viewed from the exterior 38.

Referring more particularly to the panel 64 illustrated in FIG. 6, one or more etchings 132 may be formed on the rear surface 68 of the panel 64 corresponding to a location of the various components attached to the rear surface 68. For example, etchings 132 may be formed on the rear surface 68 of the panel 64 adjacent a location at which the interface assembly 26 is attached. More particularly, the buttons 70 of the interface assembly 26 may align with one or more etchings 132 on the panel 64. The etchings 132, or holes, in the panel 64 may allow interaction with the interface assembly 26 through the panel 64 from the exterior 38.

Referring more particularly to FIG. 7, particular aspects of the openings 22, 24 are shown with the console assembly 18 in an assembled configuration. As illustrated, the first opening 22 is substantially circular and corresponds to the circular shape of a cross-section of the body 112 of the first pin 30. The second opening 24 is illustrated as having an oblong shape receiving a pin 32 having a circular cross-section. In this configuration, the first opening 22 is referred to as a narrow opening and the second opening 24 is referred to as a wide opening. The locating arrangement (e.g., the openings 22, 24 and locators 30, 32) allows the panel 64 to be substantially aligned with the console frame 20 while allowing flexibility within a given tolerance. For example, a tolerance corresponding to alignment of the panel 64 with the console frame 20 may be ±1 mm along the right and left sides of the console assembly 18, as previously discussed. In the configuration illustrated, the first opening 22 has a first perimeter $P_1$ that defines a first area $A_1$ of the first opening 22. The second opening 24 has a second perimeter $P_2$ that defines a second area $A_2$ of the second opening 24. As illustrated, the second area $A_2$ is greater than the first area $A_1$. The greater area $A_2$ of the second opening 24 can allow for sufficient room or spacing during the assembly process of the panel 64 with the console frame 20 to prevent unnecessary breakage or damage to one or more of the components of the console assembly 18. While illustrated as an oblong, the second opening 24 may form any one of a variety of shapes having a lateral dimension different than a longitudinal dimension, such as a rectangle, an oval, or the like. It is further contemplated that each opening may be referred to as thru-holes 22, 24 that extend through the entire thickness of the support member 94. In this way, the thru-holes 22, 24 allow for locators 30, 32 with varying body lengths, as the locators 30, 32 may protrude toward a back of the console frame 20.

Although illustrated as an oblong having a long axis in the right to left direction of the console assembly 18, it is generally contemplated that the wide opening 24 may extend in an up/down direction to allow deviation in the up-and-down directions. In some configurations, the first opening 22 is oblong in the right-to-left direction, and the second opening 24 is oblong in the up/down direction or vice versa. It is also generally contemplated that while the illustrated configuration includes the narrow opening 22 and an oblong opening 24, either or both of the openings 22, 24 may be oblong and/or circular to allow for greater/lesser tolerance of alignment. In the configuration illustrated, the first opening 22 has a first width $w_1$, and the second opening 24 has a second width $w_2$. The second width $w_2$ is greater than the first width $w_1$. The first width $w_1$ may correspond to (e.g., be slightly larger than) the first diameter $Ø_1$, and the second width $w_2$ may correspond to (e.g., be slightly larger than) the second diameter $Ø_2$ and a width of the oblong along a longitudinal axis of the oblong. The longitudinal axis is the longer of two axes of the oblong. In some configurations, the first opening 22 has a diameter in the range of 8% and 12% greater than either or both of the widths or the diameters $Ø_1$, $Ø_2$ of the locators 30, 32.

Figure 8:
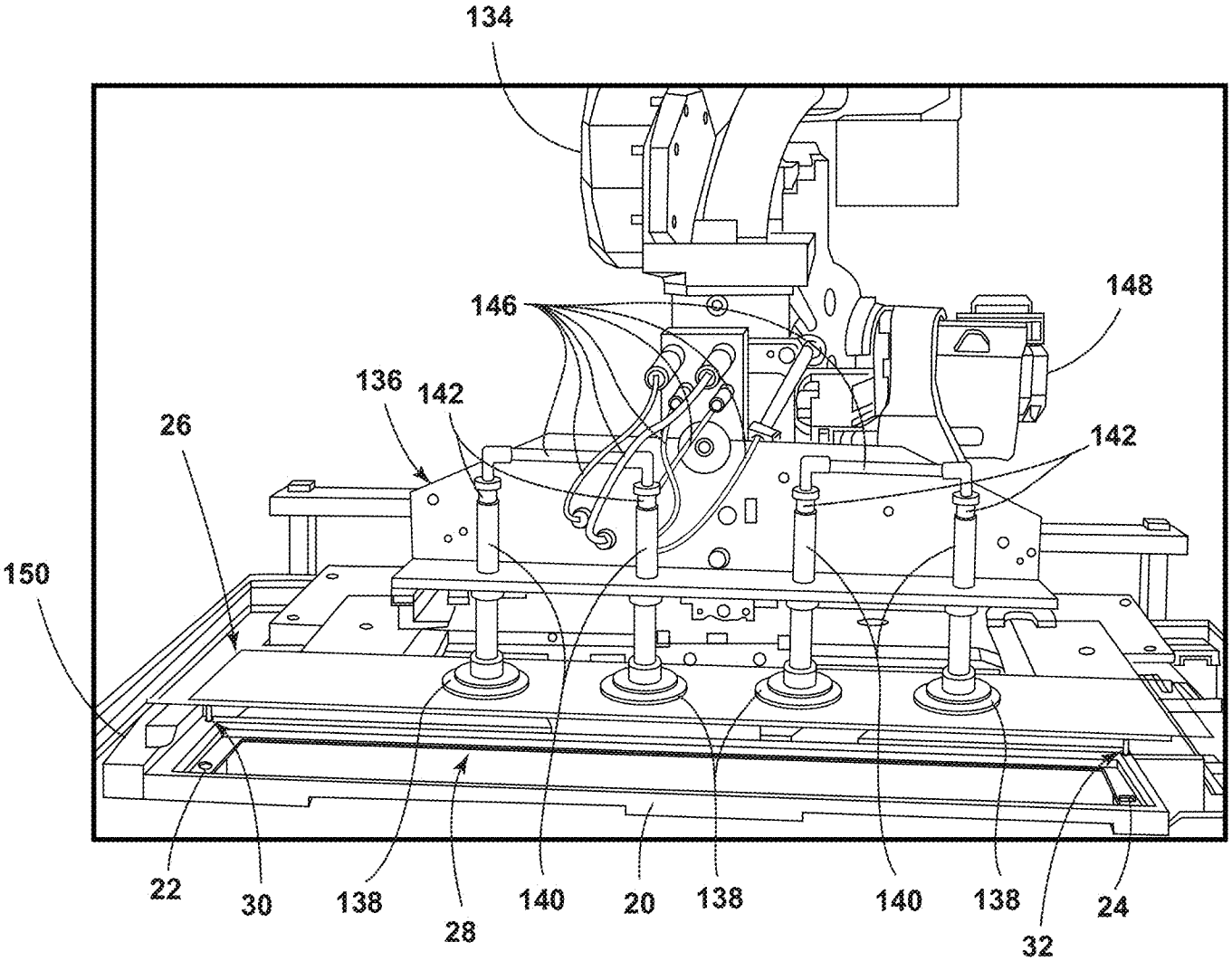
FIG. 8 is a front perspective view of an assembly machine performing one step of a method of assembling a console assembly.

Referring now to FIG. 8, a process for assembling the console assembly 18 may be implemented via an assembling machine 134, such as a robot. The machine 134 includes an end effector 136 for interacting with the console panel 64 of the console assembly 18. The machine 134 can include various selectively controlled mechanisms to allow for a controlled release of the panel 64. As illustrated, the end effector 136 includes a plurality of suction cups 138 attached to the front surface 74 of the panel 64. Each suction cup 138 is disposed at one end of a sleeve 140 that houses a fitting 142. The fitting 142 may be in fluid communication with the suction cup 138 and with a vacuum generator 144 (FIG. 10) for supplying suction to the suction cups 138 via fluid connections 146. In general, the machine 134 may be driven by one or more actuator modules 148, such as a servo motor configured to drive one axis of the robot 134. The console frame 20 is illustrated as disposed in a fixture 150 that stabilizes the console frame 20 while the assembly machine 134 applies the panel 64 to the console frame 20. The machine 134 moves the panel 64 toward the console frame 20 after application of the bonding member 28 to the console frame 20 and after application of the at least one locator 30, 32 to the panel 64.

Figure 9:
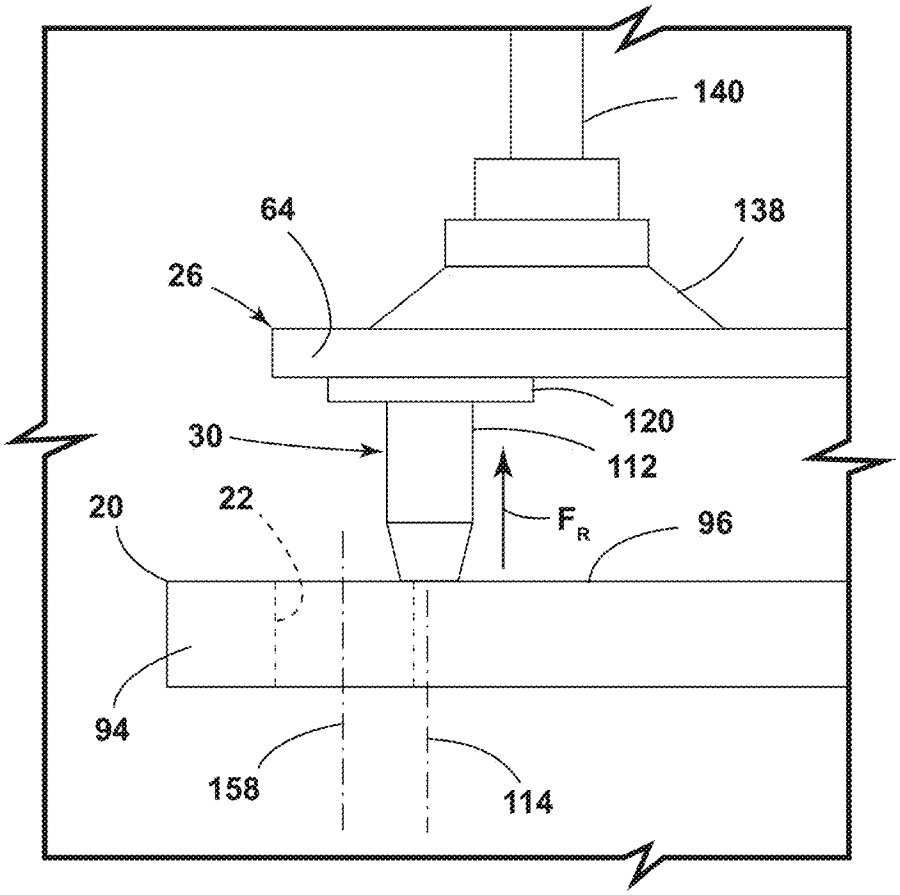
FIG. 9 is an enlarged side view of a locator misaligned with an opening of a console frame during a step of the method of assembling the console assembly.

Referring now to FIG. 9, the console panel 64 is illustrated as being misaligned with the frame 20 during assembly of the console assembly 18. As will be further discussed herein, the process for assembling the console assembly 18 may include a control unit 152 (see FIG. 10) configured to associate data from one or more sensors 154, 156 with a resistance force $F_R$ applied to the panel 64 when the locator 30, 32 engages the console frame 20. As illustrated in FIG. 9, the locator 30, 32 engages the support member 94 of the frame 20 due to misalignment of the first locator 30 with the first opening 22. As the assembly machine 134 advances the panel 64 downwardly toward the frame 20, the resistance force $F_R$ may be detected or inferred by the control unit 152 from the one or more sensors 154, 156 in communication with the control unit 152. The control unit 152 may determine that the panel 64 and the console frame 20 are misaligned based on the resistance force $F_R$. The control unit 152 may re-position the end effector 136 to re-attempt coupling the console panel 64 (of the interface assembly 26) with the console frame 20. For example, the end effector 136 may be retracted from adjacent the fixture 150, adjusted to move the console panel 64, and re-advanced toward the console frame 20. It is generally contemplated that although described in detail with respect to the first locator 30 and the first opening 22, the misalignment condition may also or alternatively be detected with the second locator 32 and the second opening 24. The control unit 152 may be configured to re-adjust the end effector 136 based on either or both of the locators 30, 32 being misaligned in order to produce an aligned console assembly 18.

According to some aspects, the resistance force $F_R$ is measured, via the one or more sensors 154, 156, in the range of 0 Newtons to approximately 200 Newtons. The control unit 152 is configured to associate the resistance force $F_R$ with a debonded condition corresponding to the locators(s) 30, 32 becoming debonded from the console panel 64. In one example, the debonded condition corresponds to a resistance force $F_R$ of 100 Newtons or more. The control unit 152 is also configured to associate the resistance force $F_R$ with a passing condition corresponding to an acceptable alignment tolerance. For example, the passing condition can correspond to a resistance force $F_R$ of 100 Newtons or less. In some examples, the acceptable alignment tolerance corresponds to an alignment tolerance of 0.5 mm from the central axis 114 of the locator 30, 32 to a target axis 158 (see FIG. 9) and corresponds to a resistance force $F_R$ of approximately 120 Newtons.

Figure 10:
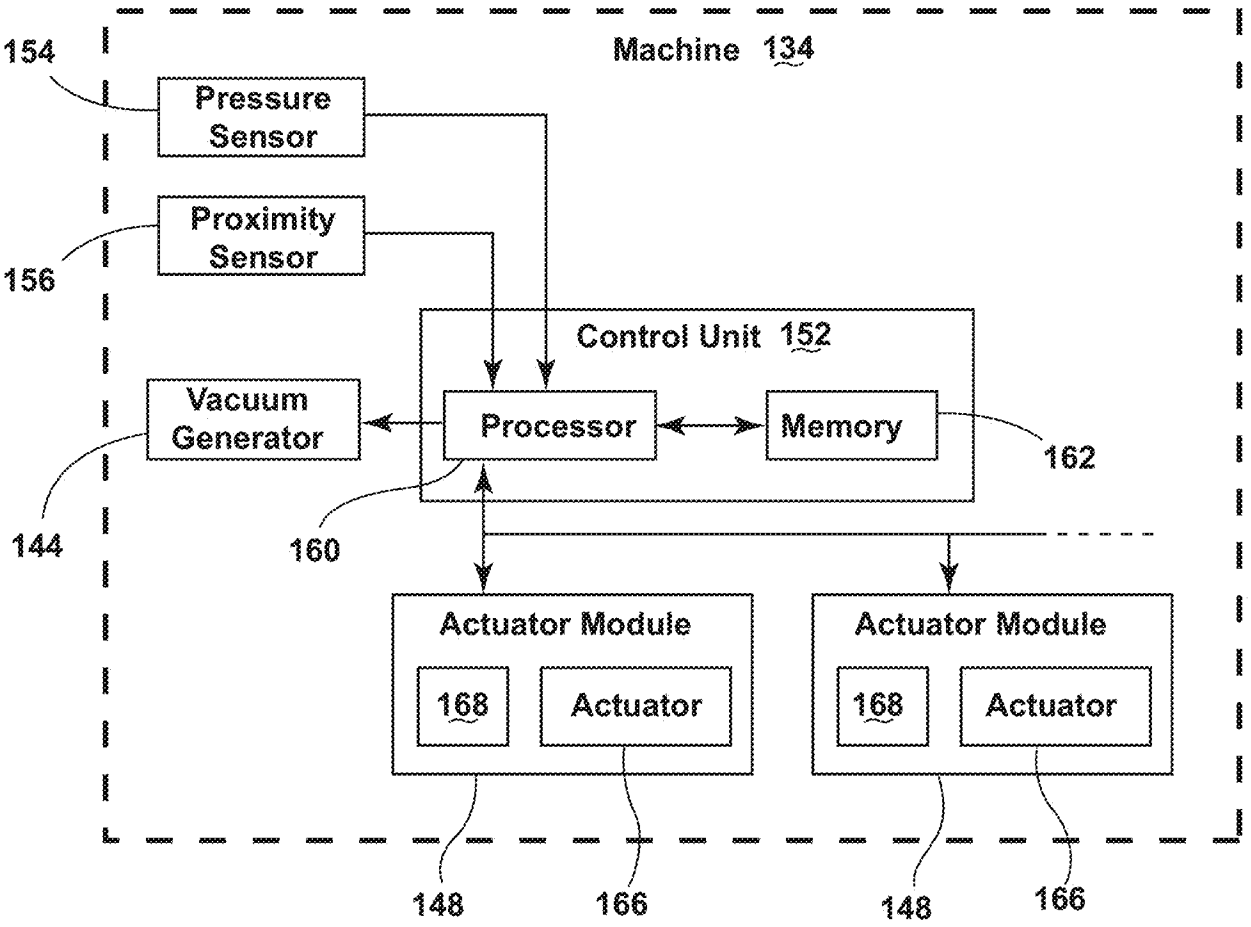
FIG. 10 is a block diagram of an assembly machine configured to perform a method of assembling a console assembly according to one aspect of the present disclosure.

Referring now to FIG. 10, the control unit 152 of the machine 134 may include a processor 160 and a memory 162. The memory 162 may store instructions that, when executed by the processor 160, cause the machine 134 to move. The one or more sensors 154, 156, may include a pressure sensor 154 and/or a proximity sensor 156 in communication with the processor 160. The control unit 152 may determine, based on the data provided from the pressure sensor 154 and/or the proximity sensor 156, that the resistance force $F_R$ is present. It is generally contemplated that the resistance force $F_R$ may be directly measured via a force or torque measuring device. Such a device may be incorporated into the one or more actuator modules 148 of the machine 134. One or more the actuator modules 148 may include an actuator 166, such as a motor or a servo motor, and a corresponding sensing circuit 168 for measuring torque, force, acceleration, distance, or the like. For example, the machine 134 may be movable via servo modules 166 having servo motors 166 and corresponding torque detection sensors 168. Based on the torque detection, the control unit 152 may determine that a resistance force $F_R$ is present and may control one or more of the actuators 166 to adjust the position of the assembly machine 134.

In some examples, torque data provided by the one or more actuator modules 148 is used to identify or infer the resistance force $F_R$. In still other examples, the air pressure sensor 154 can be associated with the suction cups 138 and used to detect or infer the resistance force $F_R$ based on a detected change in air pressure. Based on a misalignment condition, the control unit 152 may control the assembly machine 134 to position the assembly machine 134 along a different axis of alignment. In addition, the control unit 152 may control the vacuum generator to increase or decrease a suction force associated with the suction cups 138 in response to the resistance force $F_R$. It is generally contemplated that any one of a variety of sensors 154, 156 may be employed to detect the resistance force $F_R$ applied to the glass, such as the pressure sensor 154, a vacuum sensor, an encoder, data collected from a servo motor, or the like (e.g., ductwork data, torque data).

Figure 11:
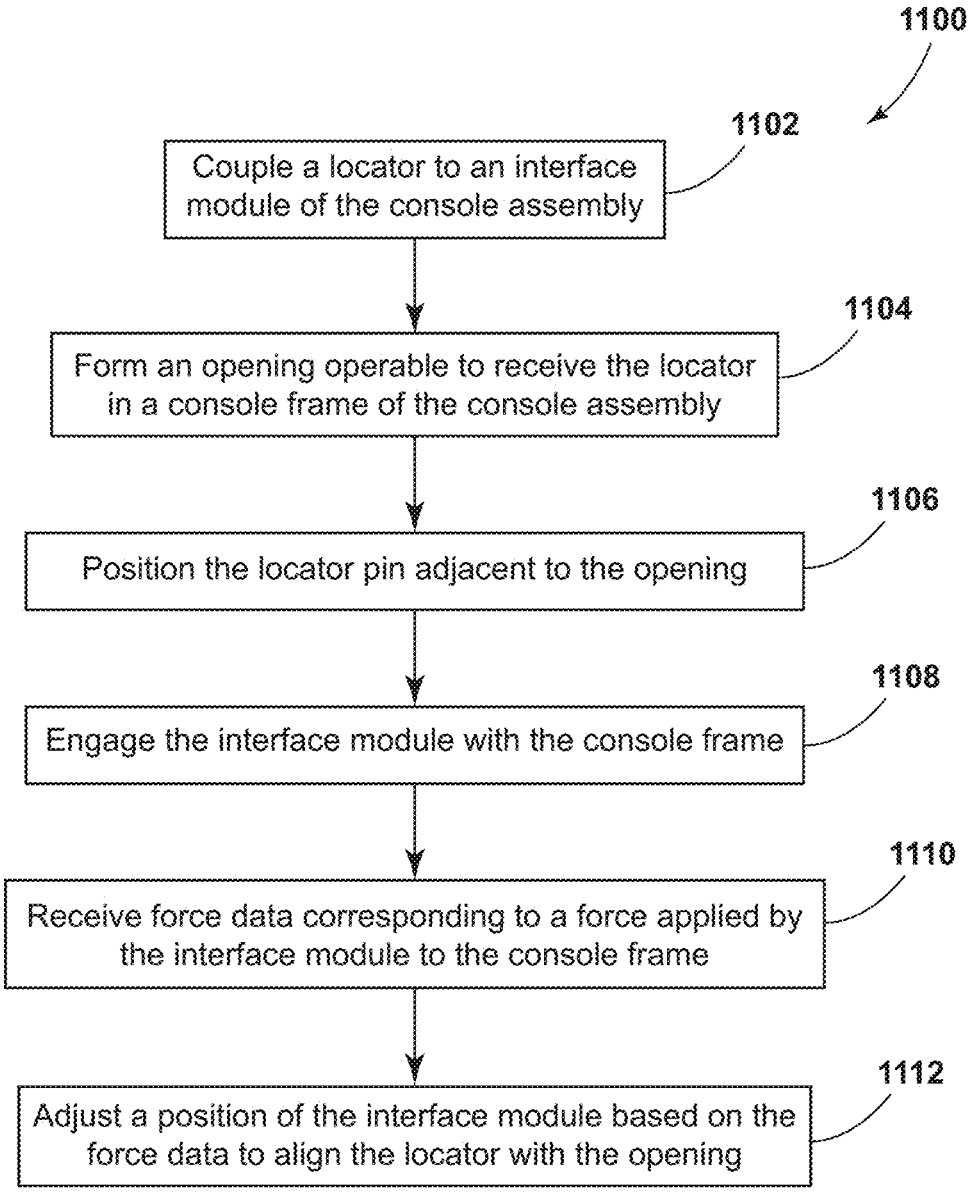
FIG. 11 is a flow diagram of a method for assembling a console assembly.

Referring now to FIG. 11, a method 1100 for assembling the console assembly 18 of the cooking appliance 10 includes coupling one or more locators 30, 32 to the interface assembly 26 of the console assembly 18 at step 1102. The method 1100 further includes forming one or more openings 22, 24 operable to receive the locators 30, 32 in the console frame 20 of the console assembly 18 at step 1104.

The method 1100 further includes positioning the one or more locators 30, 32 adjacent the one or more openings 22, 24 at step 1106. The method 1100 further includes engaging the interface assembly 26 with the console frame 20 at step 1108. The method 1100 further includes receiving force $F_R$ data corresponding to the force applied by the interface assembly 26 to the console frame 20 at step 1110. The method 1100 further includes adjusting a position of the interface assembly 26 based on the force data to align the one or more locators 30, 32 with the one or more openings 22, 24 at step 1112.

According to some aspects of the present disclosure, an alignment feature is disposed between the console frame 20 of the interface module 66. The alignment feature includes a female mating member and a male mating member. The female mating member may be formed on the console assembly 18 and the male mating member may be formed on the interface module 66. It is generally contemplated that the male mating member may be formed on the console assembly 18 and the female mating member may be formed on the interface module 66. The male member may engage the female member to align the interface module 66 to the console frame 20. In this way, misalignment of the components of the console assembly 18 may be reduced. For example, while the bonding member 28 cures, the panel 64 may be limited in lateral and/or up-and-down movements. This may allow the console assembly 18 to undergo other assembly processes (e.g., coupling the console assembly 18 with the cooking appliance 10) without causing misalignment of the panel 64 (e.g., glass) with the console frame 20. For example, the glass of the panel 64 and the console frame 20 may maintain edge-to-edge alignment during assembly of the console assembly 18.

According to one aspect of the present disclosure, a cooking appliance includes a cabinet that defines a cooking cavity. A door is coupled with the cabinet. A console assembly includes a console frame coupled with the cabinet. The console frame defines at least one opening. The console assembly includes an interface assembly for controlling an operation of the cooking appliance. A bonding member extends between the console frame and the interface assembly to form a permanent bond between the interface assembly and the console frame. At least one locator engages the at least one opening to align the interface assembly with the console frame during formation of the permanent bond.

According to another aspect of the present disclosure, the console assembly extends along a width of the cooking appliance between a first end and a second end, opposite the first end. The at least one locator includes a first pin and the at least one opening includes a first opening. The first opening is disposed adjacent the first end.

According to still another aspect of the present disclosure, the at least one locator includes a second pin and the at least one opening includes a second opening. The second opening is disposed adjacent the second end. The first pin engages the first opening and the second pin engages the second opening.

According to yet another aspect of the present disclosure, the first opening has a first width and the second opening has a second width, the second width is greater than the first width.

According to still another aspect of the present disclosure, the at least one locator is disposed adjacent a rear surface of the interface module.

According to yet another aspect of the present disclosure, the console frame includes a peripheral member that extends about a periphery of the console frame and includes and outer surface. A support member extends from the peripheral member and includes an inner surface. The console frame defines an outer recess that has a depth between the outer surface and the inner surface. The at least one opening is formed on the inner surface.

According to another aspect of the present disclosure, the bonding member is disposed in the recess.

According to still another aspect of the present disclosure, the bonding member spans the depth of the recess.

According to another aspect of the present disclosure, at least some of the at least one locator spans the depth.

According to still another aspect of the present disclosure, the at least one locator includes a body that extends between a proximal end and a distal end and into the at least one opening along a central axis. A base is coupled to the body. The base includes an attachment surface that faces the interface module and an intermediate surface connects the base with the body at the proximal end.

According to another aspect of the present disclosure, the body has a frustoconical shape adjacent to the distal end.

According to another aspect of the present disclosure, an attachment member is disposed between the interface module and the at least one locator to couple the at least one pin with the interface module.

According to another aspect of the present disclosure, the attachment member includes a first surface and a second surface that is opposite the first surface. The first surface adhesively couples with a rear surface of the interface module and the second surface adhesively couples with the at least one locator.

According to another aspect, a console assembly for a cooking appliance includes an interface assembly for controlling an operation of the cooking appliance. A console frame operably couples the interface assembly with the cooking appliance. The console frame defines at least one opening. A bonding member is disposed between the console frame and the interface assembly. At least one pin extends from the interface assembly and is configured to engage the at least one opening to align the interface assembly with the console frame.

According to another aspect of the present disclosure, the at least one pin includes a first pin that has a first width. A second pin that is spaced from the first pin and that has a second width. The first diameter and the second diameter are substantially equal.

According to another aspect of the present disclosure, the at least one opening includes a first opening and a second opening. The first pin engages the first opening and the second pin engages the second opening.

According to still another aspect of the present disclosure, the first opening has a first perimeter that defines a first area of the first opening and the second opening has a second perimeter that defines a second area of the second opening. The second area is greater than the first area.

According to yet another aspect of the present disclosure, the first opening is circular and the second opening is obround.

According to another aspect of the present disclosure, each of the first opening and the second opening has a diameter in the range of 8% and 12% greater than each of the first diameter and the second diameter.

According to yet another aspect, a method used to assemble a console assembly of a cooking appliance includes a step where a locator is coupled with an interface assembly of the console assembly. An opening is operable to receive the locator in a console frame of the console assembly. The locator is adjacent to the opening. The interface assembly engages with the console frame. Force data is received and corresponds to a force applied by the interface assembly to the console frame. A position of the interface assembly is adjusted based on the force data to align the locator with the opening.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance comprising:

a cabinet defining a cooking cavity;

a door coupled with the cabinet for selectively covering the cooking cavity; and a console assembly coupled with the cabinet, the console assembly comprising:

a console frame coupled with the cabinet, the console frame defining at least one opening;

an interface assembly for controlling an operation of the cooking appliance;

a bonding member extending between the console frame and the interface assembly to form a permanent bond between the interface assembly and the console frame;

at least one locator engaging the at least one opening to align the interface assembly with the console frame during formation of the permanent bond;

a peripheral member extending about a periphery of the console frame and including an outer surface; and a support member extending from the peripheral member and including an inner surface, the console frame defining an outer recess having a depth between the outer surface and the inner surface, wherein the at least one opening is formed on the inner surface, wherein at least some of the at least one locator is a first pin that spans the depth.

2. The cooking appliance of claim 1, wherein the console assembly extends along a width of the cooking appliance between a first end and a second end, opposite the first end, wherein the at least one opening includes a first opening, and wherein the first opening is disposed adjacent the first end.

3. The cooking appliance of claim 2, further comprising:

a second pin and the at least one opening includes a second opening, wherein the second opening is disposed adjacent the second end, and wherein the first pin engages the first opening and the second pin engages the second opening.

4. The cooking appliance of claim 3, wherein the first opening has a first width and the second opening has a second width, the second width being greater than the first width.

5. The cooking appliance of claim 1, wherein the at least one locator contacts a rear surface of the interface assembly.

6. The cooking appliance of claim 1, wherein the bonding member is disposed in the recess.

7. The cooking appliance of claim 1, wherein the bonding member spans the depth of the recess.

8. The cooking appliance of claim 1, the at least one locator comprising:

a body extending between a proximal end and a distal end and into the at least one opening along a central axis; and a base coupled to the body, the base including an attachment surface facing the interface assembly and an intermediate surface connecting the base with the body at the proximal end.

9. The cooking appliance of claim 8, wherein the body has a frustoconical shape adjacent the distal end.

10. The cooking appliance of claim 1, further comprising:

an attachment member disposed between the interface assembly and at least one locator to couple the at least one locator with the interface assembly.

11. The cooking appliance of claim 10, wherein the attachment member includes a first surface and a second surface opposite the first surface, the first surface adhesively coupling with a rear surface of the interface assembly and the second surface adhesively coupling with the at least one locator.

* * * * *